US009567176B2

(12) United States Patent
Mizutani et al.

(10) Patent No.: US 9,567,176 B2
(45) Date of Patent: Feb. 14, 2017

(54) ROLLED RECORDING MEDIUM CONVEYANCE DEVICE, IMAGE FORMING APPARATUS, ROLLED RECORDING MEDIUM CONVEYANCE METHOD, AND COMPUTER PROGRAM PRODUCT

(71) Applicants: Tomohiro Mizutani, Tokyo (JP); Suguru Yokozawa, Kanagawa (JP); Takashi Hatano, Kanagawa (JP)

(72) Inventors: Tomohiro Mizutani, Tokyo (JP); Suguru Yokozawa, Kanagawa (JP); Takashi Hatano, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/094,596

(22) Filed: Dec. 2, 2013

(65) Prior Publication Data

US 2014/0151491 A1 Jun. 5, 2014

(30) Foreign Application Priority Data

Dec. 4, 2012 (JP) ..... 2012-264904

(51) Int. Cl.

| | |
|---|---|
| ***B65H 26/08*** | (2006.01) |
| ***B65H 26/06*** | (2006.01) |
| *B41J 29/38* | (2006.01) |
| *B41J 29/48* | (2006.01) |
| *B65H 23/00* | (2006.01) |

(52) U.S. Cl.

CPC ..... *B65H 26/063* (2013.01); *B41J 29/38* (2013.01); *B41J 29/48* (2013.01); *B65H 23/005* (2013.01); *B65H 26/08* (2013.01); *B65H 2403/942* (2013.01); *B65H 2404/143* (2013.01); *B65H 2511/51* (2013.01); *B65H 2801/36* (2013.01)

(58) Field of Classification Search

CPC ..... B65H 26/06; B65H 26/063

See application file for complete search history.

(56) References Cited

U.S. PATENT DOCUMENTS

| | | | | | |
|---|---|---|---|---|---|
| 4,204,180 | A | * | 5/1980 | Usui et al. | 335/205 |
| 4,925,121 | A | * | 5/1990 | Tapscott et al. | 242/563.2 |
| 5,708,911 | A | * | 1/1998 | Kageyama | B65H 26/02 399/23 |
| 5,820,068 | A | * | 10/1998 | Hosomi et al. | 242/563 |
| 6,041,693 | A | | 3/2000 | Fukushima | |

(Continued)

FOREIGN PATENT DOCUMENTS

| | | | |
|---|---|---|---|
| JP | 55089938 | A | 7/1980 |
| JP | 06-003962 | U | 1/1994 |

(Continued)

*Primary Examiner* — Jill Culler

(74) *Attorney, Agent, or Firm* — Duft Bornsen & Fettig LLP

(57) ABSTRACT

In an image forming apparatus that the present invention is concerning to, rolled paper is conveyed in a forward conveyance direction for a predetermined period of time, when it is detected that an amount of the rolled paper rolled around a core pipe equals a predetermined amount or less. On the basis of the detection result, a CPU determines the rolled state of the rolled paper with respect to the core pipe and conveys the rolled paper in the forward conveyance direction or a reverse conveyance direction according to the rolled state.

8 Claims, 7 Drawing Sheets

(56) References Cited

U.S. PATENT DOCUMENTS

| | | | | |
|---|---|---|---|---|
| 6,091,928 | A * | 7/2000 | Fuchisawa | B41J 11/006 399/384 |
| 2006/0115313 | A1 * | 6/2006 | Shaw, III | 400/621 |

FOREIGN PATENT DOCUMENTS

| | | |
|---|---|---|
| JP | 117578 | 1/1999 |
| JP | 2002302313 | 10/2002 |
| JP | 2004-136514 | 5/2004 |
| JP | 2009-269713 | 11/2009 |
| JP | 2011-073820 | 4/2011 |

* cited by examiner

ADHERED (FIXED STATE)

EASILY COMING OFF (UNFIXED STATE)

EASILY AND DIVIDEDLY COMING OFF
(INCOMPLETELY-FIXED STATE)

ROLLED RECORDING MEDIUM CONVEYANCE DEVICE, IMAGE FORMING APPARATUS, ROLLED RECORDING MEDIUM CONVEYANCE METHOD, AND COMPUTER PROGRAM PRODUCT

CROSS-REFERENCE TO RELATED APPLICATIONS

The present application claims priority to and incorporates by reference the entire contents of Japanese Patent Application No. 2012-264904 filed in Japan on Dec. 4, 2012.

BACKGROUND OF THE INVENTION

1. Field of the Invention

The present invention relates to a rolled recording medium conveyance device, an image forming apparatus, a rolled recording medium conveyance method, and a computer program product that contains a rolled recording medium conveyance program. Particularly, the present invention relates to a rolled recording medium conveyance device, an image forming apparatus, a rolled recording medium conveyance method, and a computer program product that contains a rolled recording medium conveyance program by which an end edge portion of a rolled recording medium such as roll paper is properly discharged from a conveyance path.

2. Description of the Related Art

An image forming apparatus which forms an image on a wide sheet of paper with an AO width or the like generally uses roll paper to form an image thereon, where the roll paper is provided in the form of a long piece of paper rolled around a core pipe.

The image forming apparatus using such roll paper performs printing by pulling paper out of the roll paper according to the length of an image to be printed, pulls the roll paper out to a cutter position according to the length of the printed image, and cuts the paper being pulled out.

Having cut the roll paper, the image forming apparatus using the roll paper discharges the paper on which the image is formed to a paper discharge tray, conveys the roll paper in a reverse conveyance direction (a direction opposite to a forward conveyance direction) by rolling the roll paper back around the core pipe to a predetermined standby position, and stands by for the next image formation.

The roll paper includes the one with an end edge thereof adhered to the core pipe and the one with the end edge simply rolled around the core pipe without being adhered thereto.

When the roll paper has a free end edge which comes off of the core pipe, the image forming apparatus using such roll paper generally employs two methods to detect the end edge of the roll paper, or a roll end, in the related art. One detection method is a sensor method in which a detection result by a roll paper detection sensor changes from a result indicating there is paper to a result indicating there is no paper, the roll paper detection sensor detecting the presence of the roll paper disposed on a conveyance path provided for the roll paper. Another detection method is an encoder method in which a detection result by an encoder shows a rapid increase (idling), the encoder detecting rotation of a conveyance motor which conveys the roll paper.

Now, there has been proposed in the related art a recording device which uses a recording head to perform recording on roll paper discharged from a roll paper shaft and includes a near-end edge detection unit which detects that the roll paper has come close the end edge thereof and a roll paper drive unit which drives the roll paper (refer to Japanese Laid-open Patent Publication No. 2009-269713). This recording device determines whether or not the end edge of the roll paper is fixed to the roll paper shaft and thus cannot be conveyed, when the near-end edge detection unit has detected the vicinity of the end edge of the roll paper, by changing a driving condition of the roll paper drive unit.

That is, in this technology in the related art, upon detecting the vicinity of the end edge of the roll paper and detecting whether or not the end edge of the roll paper is fixed to the core pipe, and in case the end edge is not fixed, this technology is aimed to not waste but use the end edge portion of the roll paper.

However, in the aforementioned technology in the related art, even when the roll end is detected, there has been a possible problem that a fragmentary piece of the roll paper is left on the conveyance path when the end edge of the roll paper is weakly adhered to the core pipe, thereby requiring a great amount of work to take out the piece of paper.

In other words, the roll paper is sometimes incompletely adhered to the core pipe so that the end edge of the roll paper is peeled dividedly from the core pipe (falls off in a fragment). There is a possibility, for such roll paper with the end edge being easily peeled dividedly from the core pipe, that the end edge of the roll paper comes off of the core pipe while the roll paper is rolled back near the end edge thereof. There has been a problem that, when the end edge of the roll paper comes off of the core pipe while it is rolled back, a fallen fragment of the peeled end edge portion of the roll paper is left in the conveyance path so that the usability of a device is decreased due to work for removing of the fragment.

Now, in view of the above-mentioned problems in the aforementioned technology, there is needed to discharge the fallen end edge portion of a rolled recording medium from the conveyance path.

SUMMARY OF THE INVENTION

It is an object of the present invention to at least partially solve the problems in the conventional technology.

According to the present invention, there is provided: a rolled recording medium conveyance device comprising: a conveyance unit configured to convey a recording medium pulled out from the recording medium in a rolled state, with a forward conveyance direction corresponding to a direction in which the recording medium is pulled out; a first recording medium detection unit configured to output a predetermined signal, when an edge portion of the recording medium on an upstream side of the forward conveyance direction is not detached from a core portion of the rolled recording medium and an amount of the rolled recording medium equals a predetermined amount or less; a second recording medium detection unit configured to detect presence of the recording medium on a downstream side of the first recording medium detection unit in the forward conveyance direction; a control unit configured to convey the recording medium being pulled out by the conveyance unit for a predetermined period of time in the forward conveyance direction, when the first recording medium detection unit has output the predetermined signal, and cause the conveyance unit to convey the recording medium in the forward conveyance direction or a reverse conveyance direction opposite from the forward conveyance direction on the basis of a detection result by at least either the first recording medium detection unit or the second recording medium detection unit while or after the recording medium is conveyed for the predetermined period of time.

The present invention also provides a rolled recording medium conveyance method comprising: a conveyance process step in which a recording medium pulled out from the recording medium in a rolled state is conveyed with a forward conveyance direction corresponding to a direction in which the recording medium is pulled out; a first recording medium detection process step in which when an edge portion of the recording medium on an upstream side of the forward conveyance direction is not detached from a core portion of the rolled recording medium and an amount of the rolled recording medium equals a predetermined amount or less, a predetermined signal is output; a second recording medium detection process step in which it is determined whether or not the recording medium is presented on a downstream side of the first recording medium detection process step in the forward conveyance direction; a conveyance control process step in which when the predetermined signal is output in the first recording medium detection process step, the recording medium being pulled out in the conveyance process step is conveyed for a predetermined period of time in the forward conveyance direction, and a control process step in which the recording medium is conveyed in the forward conveyance direction or a reverse conveyance direction opposite from the forward conveyance direction in the conveyance process step, on the basis of a detection result by at least either the first recording medium detection process step or the second recording medium detection process step while or after the recording medium is conveyed for the predetermined period of time in the conveyance control process step.

The present invention also provides a computer program product comprising a non-transitory computer-readable recording medium having a rolled recording medium conveyance program which causes a computer to execute a process comprising: a conveyance process step in which a recording medium pulled out from the recording medium in a rolled state is conveyed with a forward conveyance direction corresponding to a direction in which the recording medium is pulled out; a first recording medium detection process step in which when an edge portion of the recording medium on an upstream side of the forward conveyance direction is not detached from a core portion of the rolled recording medium and an amount of the rolled recording medium equals a predetermined amount or less, a predetermined signal is output; a second recording medium detection process step in which it is determined whether or not the recording medium is presented on a downstream side of the first recording medium detection process step in the forward conveyance direction; a conveyance control process step in which when the predetermined signal is output in the first recording medium detection process step, the recording medium being pulled out in the conveyance process step is conveyed for a predetermined period of time in the forward conveyance direction, and a control process step in which the recording medium is conveyed in the forward conveyance direction or a reverse conveyance direction opposite from the forward conveyance direction in the conveyance process step, on the basis of a detection result by at least either the first recording medium detection process step or the second recording medium detection process step while or after the recording medium is conveyed for the predetermined period of time in the conveyance control process step.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

A preferred embodiment of the present invention will now be described in detail on the basis of the attached drawings. Note that while various limitations that are technically preferable are added to the preferred embodiment of the present invention to be described below, the scope of the present invention is not to be limited inappropriately by the description below. Moreover, not all the configurations described in the present embodiment are required components of the present invention.

First Embodiment

Figure 1:
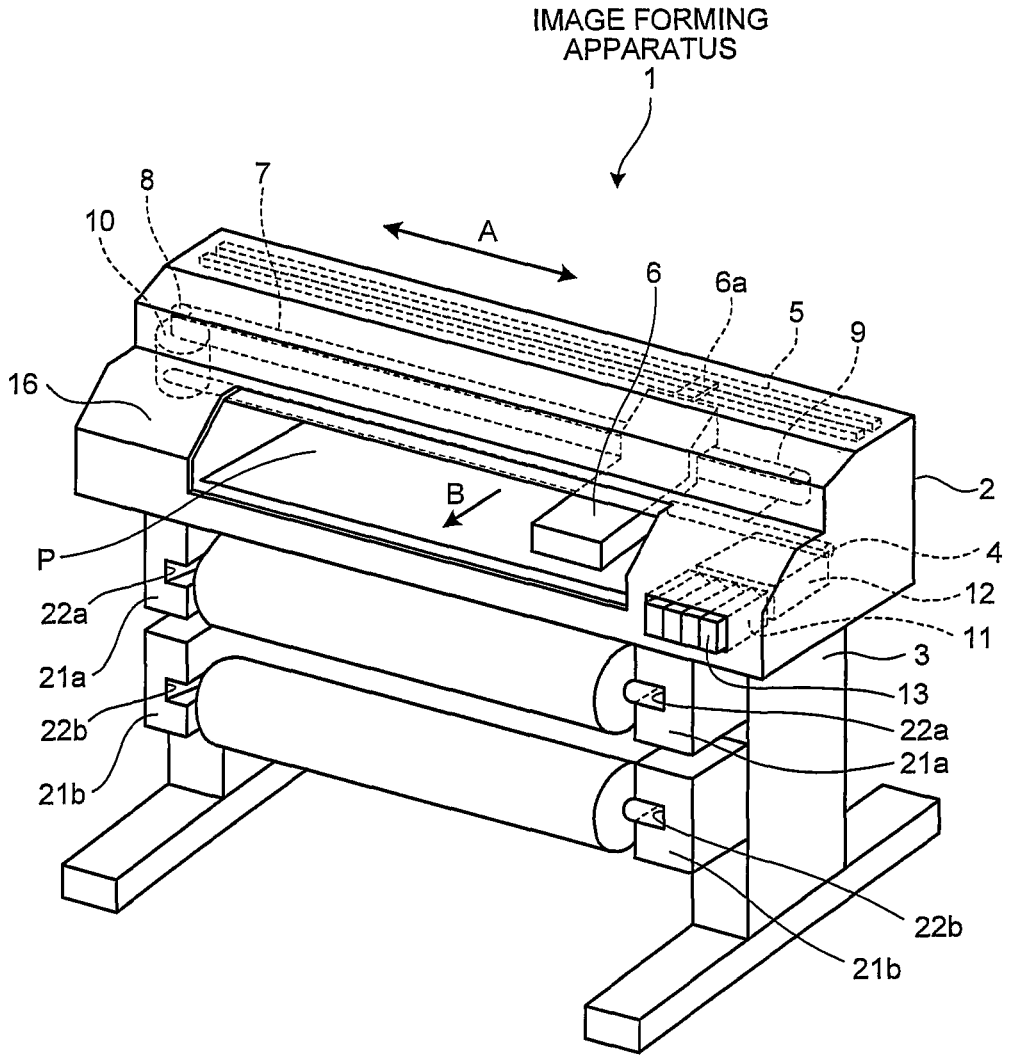
FIG. 1 is a schematic perspective view of an image forming apparatus to which an embodiment of the present invention is applied.

FIGS. 1 to 7 are diagrams illustrating an embodiment of a rolled recording medium conveyance device, an image forming apparatus, a rolled recording medium conveyance method, and a rolled recording medium conveyance computer program that is contained in a computer-readable recording medium according to the present invention. FIG. 1 is a schematic perspective view of an image forming apparatus 1 applying an embodiment of the rolled recording medium conveyance device, the image forming apparatus, the rolled recording medium conveyance method, and the rolled recording medium conveyance computer program according to the present invention.

The image forming apparatus 1 illustrated in FIG. 1 is an image forming apparatus employing a serial-type liquid ejection method (ink ejection method) where a body housing 2 is disposed above a body frame 3. Provided in the body housing 2 of the image forming apparatus 1 are a main guide rod 4 and a sub guide rod 5 that stretch across a main-scanning direction indicated by a two-way arrowed line A in FIG. 1. The main guide rod 4 movably supports a carriage 6, which is provided with a connecting piece 6*a* that engages with the sub guide rod 5 to stabilize the position of the carriage 6.

A timing belt 7 in an endless belt shape is disposed along the main guide rod 4 of the image forming apparatus 1 and stretches between a drive pulley 8 and a driven pulley 9. The drive pulley 8 is rotated by a main scanning motor 10, while the driven pulley 9 is disposed in a state to give predetermined tension to the timing belt 7. The drive pulley 8 is rotated by the main scanning motor 10 to rotate and move the timing belt 7 in the main-scanning direction according to the direction of rotation of the pulley.

The carriage 6 is connected to the timing belt 7 and thus moves back and forth in the main-scanning direction along the main guide rod 4 when the timing belt 7 is rotated and moves in the main-scanning direction by the drive pulley 8.

The body housing 2 of the image forming apparatus 1 stores cartridge units 11 and maintenance mechanism units 12 at positions corresponding to both end portions of the main-scanning direction. Each of the cartridge units 11 replaceably stores a cartridge 13 which stores each one of yellow (Y), magenta (M), cyan (C), and black (K) ink. Each cartridge of the cartridge units 11 is connected, by a pipe not shown, to a recording head of a corresponding color of a recording head (not shown) mounted in the carriage 6 so that ink is supplied to the recording head of each color from the cartridge through the pipe.

As described later, the image forming apparatus 1 records an image onto a recording medium P by ejecting ink onto the recording medium (a rolled recording medium) P while moving the carriage 6 in the main-scanning direction, the recording medium P being intermittently conveyed on a platen 14 (refer to FIG. 2) in a sub-scanning direction (a direction indicated by an arrowed line B in FIG. 1) orthogonal to the main-scanning direction. While various kinds of mediums such as rolled paper or a rolled film can be used as the recording medium P, rolled paper P or simply paper P will be used in the description below in order to provide clear description.

Figure 2:
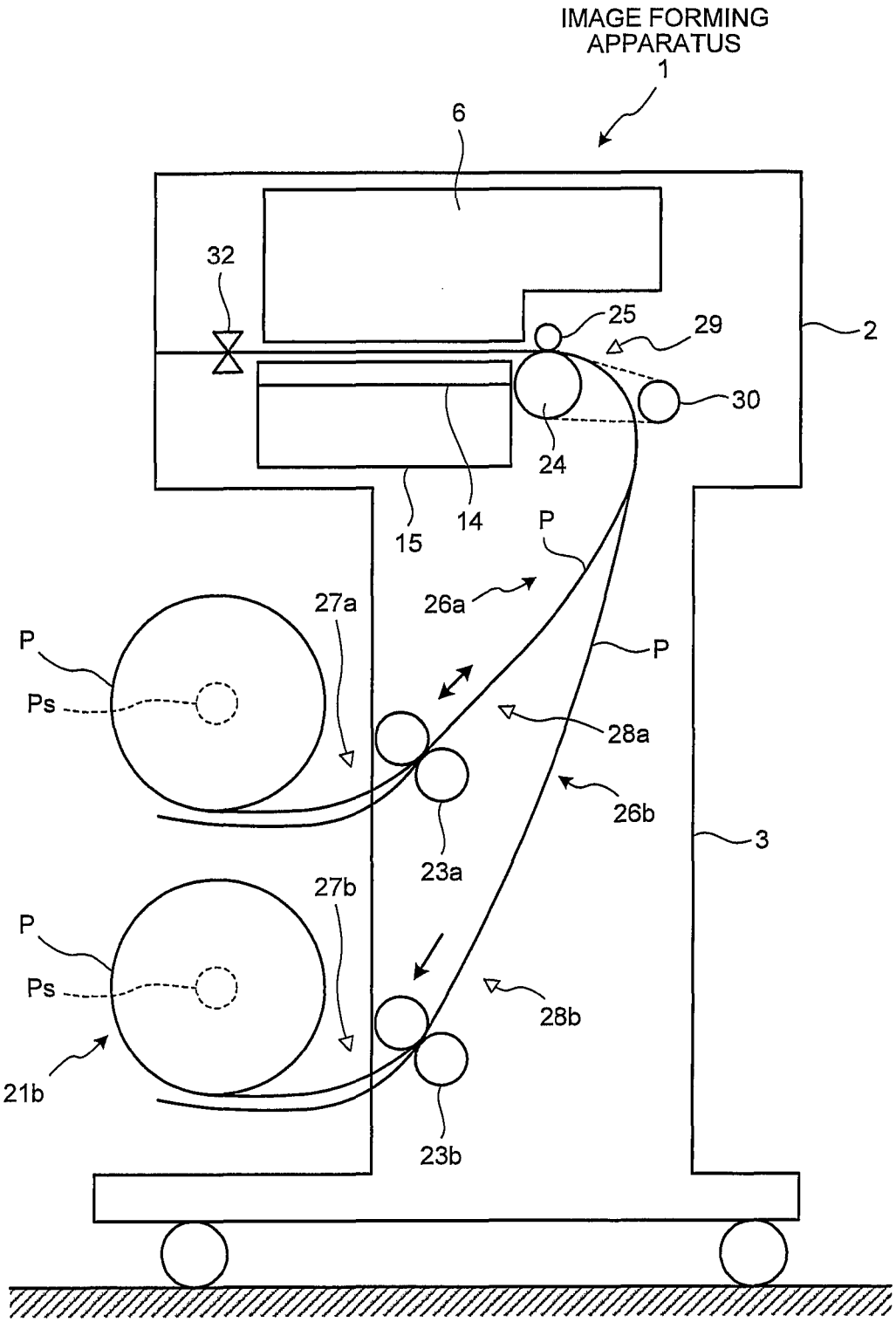
FIG. 2 is a schematic structural view of a side face of the image forming apparatus.

As illustrated in FIG. 2, the image forming apparatus 1 is provided with a fan 15 that is disposed below the platen 14 and driven to cause the rolled paper P close to the platen 14, thereby the image forming apparatus conveys the rolled paper P on the platen 14 while bringing it close to the platen 14.

The image forming apparatus 1 intermittently conveys the rolled paper P in the sub-scanning direction and, while the rolled paper P is not conveyed in the sub-scanning direction, forms (records) an image onto the rolled paper P by moving the carriage 6 in the main-scanning direction and ejecting the ink onto the rolled paper P placed on the platen 14 from a nozzle array of the recording head mounted in the carriage 6.

The maintenance mechanism unit 12 discharges unwanted ink from the recording head and maintains reliability of the recording head by cleaning an ejection surface of the recording head, capping, ejecting the unwanted ink, and the like.

Referring back to FIG. 1, the image forming apparatus 1 is provided with a cover 16 such that a portion where the rolled paper P is conveyed can be opened/closed. The cover 16 of the image forming apparatus 1 can be opened at the time of maintenance or a jam occurred in the image forming apparatus 1 so that work including maintenance or removal of the jammed rolled paper P can be performed inside the body housing 2.

The image forming apparatus 1 is provided with an encoder sheet (not shown) that is disposed across at least a moving range of the carriage 6 and parallel to the timing belt 7, namely, the main guide rod 4. An encoder sensor 21 (refer to FIG. 4) which reads the encoder sheet is attached to the carriage 6. The image forming apparatus 1 controls the movement of the carriage 6 in the main-scanning direction by controlling the driving of the main scanning motor 10 on the basis of the result of reading the encoder sheet by the encoder sensor 21.

As illustrated in FIGS. 1 and 2, the body frame 3 supporting the body housing 2 in the image forming apparatus 1 is provided with two spool bearing stands 21*a* and 21*b* in a vertical direction of FIGS. 1 and 2. The spool bearing stands 21*a* and 21*b* are provided with supporting portions 22*a* and 22*b*, respectively, that are formed to rotatably support a core pipe Ps of each rolled paper P.

That is, the rolled paper P is provided in the form of the paper P rolled around the core pipe Ps, where a tip portion of the paper is pulled out to be the rolled paper P on which an image is to be recorded. The rolled paper P with an end edge portion thereof rolled around the core pipe Ps includes the one with the end edge being adhered to the core pipe Ps by an adhesive or the like and the one with the end edge being simply rolled around the core pipe Ps without being adhered thereto. When adhered to the core pipe Ps, the end edge of the rolled paper P is adhered in varying degrees where some do not easily come off while others come off easily. While the end edge portion of the rolled paper (a rolled recording member) P in the present embodiment is rolled around the core pipe Ps, the core pipe Ps may not be provided so that the end edge portion is simply rolled up. A core portion in the present invention indicates both the portion rolled around the core pipe Ps and the portion rolled up with no core pipe Ps present.

The image forming apparatus 1 conveys the rolled paper P set in the spool bearing stands 21*a* and 21*b* and pulled out from the leading end of the rolled paper P onto conveyance paths 26*a* and 26*b* by a pair of conveyance rollers 23*a* and 23*b*, a registration roller 24, and a registration pressure roller 25 as illustrated by an arrowed line in FIG. 2 and then onto the platen 14.

Disposed in the conveyance paths 26*a* and 26*b* between the spool bearing stands 21*a* and 21*b* and the platen 14 in the image forming apparatus 1 are various sensors such as roll end detection sensors 27*a* and 27*b* and paper feeding exit sensors 28*a* and 28*b*, respectively, as well as a pre-registration sensor 29.

The paper feeding exit sensors 28*a* and 28*b* and the pre-registration sensor 29 use a reflection light sensor, for example, where the conveyance paths 26*a* and 26*b* are irradiated with detection light in order to detect presence of the rolled paper P by the presence of reflected light from the rolled paper P being conveyed through the conveyance paths 26*a* and 26*b*. That is, the paper feeding exit sensors 28*a* and 28*b* and the pre-registration sensor 29 output an OFF output signal when the rolled paper is present in the conveyance paths 26*a* and 26*b* and output an ON output signal when the rolled paper P runs out and no reflected light from the rolled paper P is detected.

Figure 3:
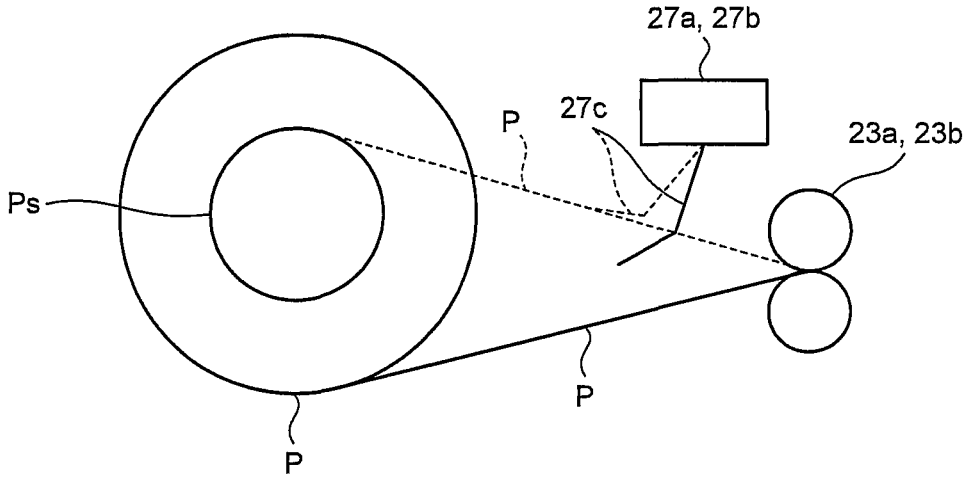
FIG. 3 is a diagram illustrating a detection operation performed by a roll end detection sensor.

As illustrated in FIG. 3, the roll end detection sensors (first recording medium detection units) 27*a* and 27*b* are disposed in the vicinity of the rolled paper P and include a detection arm 27*c* which extends in the direction of the rolled paper P pulled out from an outer peripheral surface of the rolled paper P to the pair of conveyance rollers 23*a* and 23*b*. The detection arm 27*c* is separated from the rolled paper P and is turned OFF, as illustrated by a solid line in FIG. 3, when a predetermined amount or more of the rolled paper P is rolled around the core pipe Ps. On the other hand, the detection arm 27*c* is pressed against the rolled paper P adhered to the core pipe Ps and is turned ON, as illustrated by a dotted line in FIG. 3, when the rolled paper P has been used up to a position close to the core pipe Ps and has reached the roll end. Although not shown in FIG. 3, the detection arm 27*c* remains turned OFF without being turned ON when a rear end of the rolled paper P is not adhered to the core pipe Ps and "easily" comes off upon conveyance.

The paper feeding exit sensors 28*a* and 28*b* detect the presence of the rolled paper P at a position on a downstream side of the pair of conveyance rollers 23*a* and 23*b* in the forward conveyance direction, while the pre-registration sensor 29 detects the presence of the rolled paper P at a position before the registration roller 24. The paper feeding exit sensors 28*a* and 28*b* and the pre-registration sensor 29 function as a second recording medium detection unit that detects the presence of the rolled paper P on the downstream side of the first recording medium detection unit in the forward conveyance direction.

The registration roller 24 is rotated by a registration motor 30 (refer to FIG. 4), abuts on the registration pressure roller 25, and is rotated in a normal direction (a counterclockwise direction in FIG. 2) to convey the rolled paper P in a direction from the spool bearing stands 21*a* and 21*b* onto the platen 14 (the forward conveyance direction). Moreover, the registration roller 24 is rotated in a reverse direction (a clockwise direction in FIG. 2) by the registration motor 30 to convey backward the rolled paper P from onto the platen 14 into the direction of the spool bearing stands 21*a* and 21*b* (the reverse conveyance direction).

The pair of conveyance rollers 23*a* and 23*b* are rotated in the normal direction by a paper feeding motor 31 (refer to FIG. 4) to convey the rolled paper P in the direction from the spool bearing stands 21*a* and 21*b* onto the platen 14 (the forward conveyance direction). Moreover, the pair of conveyance rollers 23*a* and 23*b* are rotated in the reverse direction by the paper feeding motor 31 to convey backward the rolled paper P from the top face of the platen 14 into the direction of the spool bearing stands 21*a* and 21*b* (the reverse conveyance direction).

The pair of conveyance rollers 23*a* and 23*b*, the paper feeding motor 31, the registration roller 24, the registration pressure roller 25 and the registration motor 30 as a whole function as a conveyance unit which conveys the rolled paper P pulled out from the rolled paper (the recording medium) P that is rolled around the core pipe Ps, with the forward conveyance direction corresponding to the direction into which the rolled paper P is pulled out from the core pipe Ps.

Disposed on an exit side of the platen 14 in the forward conveyance direction of the rolled paper P in the image forming apparatus 1 is a cutter 32 which extends in the sub-scanning direction (a paper width direction).

The cutter 32 cuts off the tip portion of the rolled paper P in order to align the tip thereof and also cuts the rolled paper P on which an image is recorded at an appropriate position.

Figure 4:
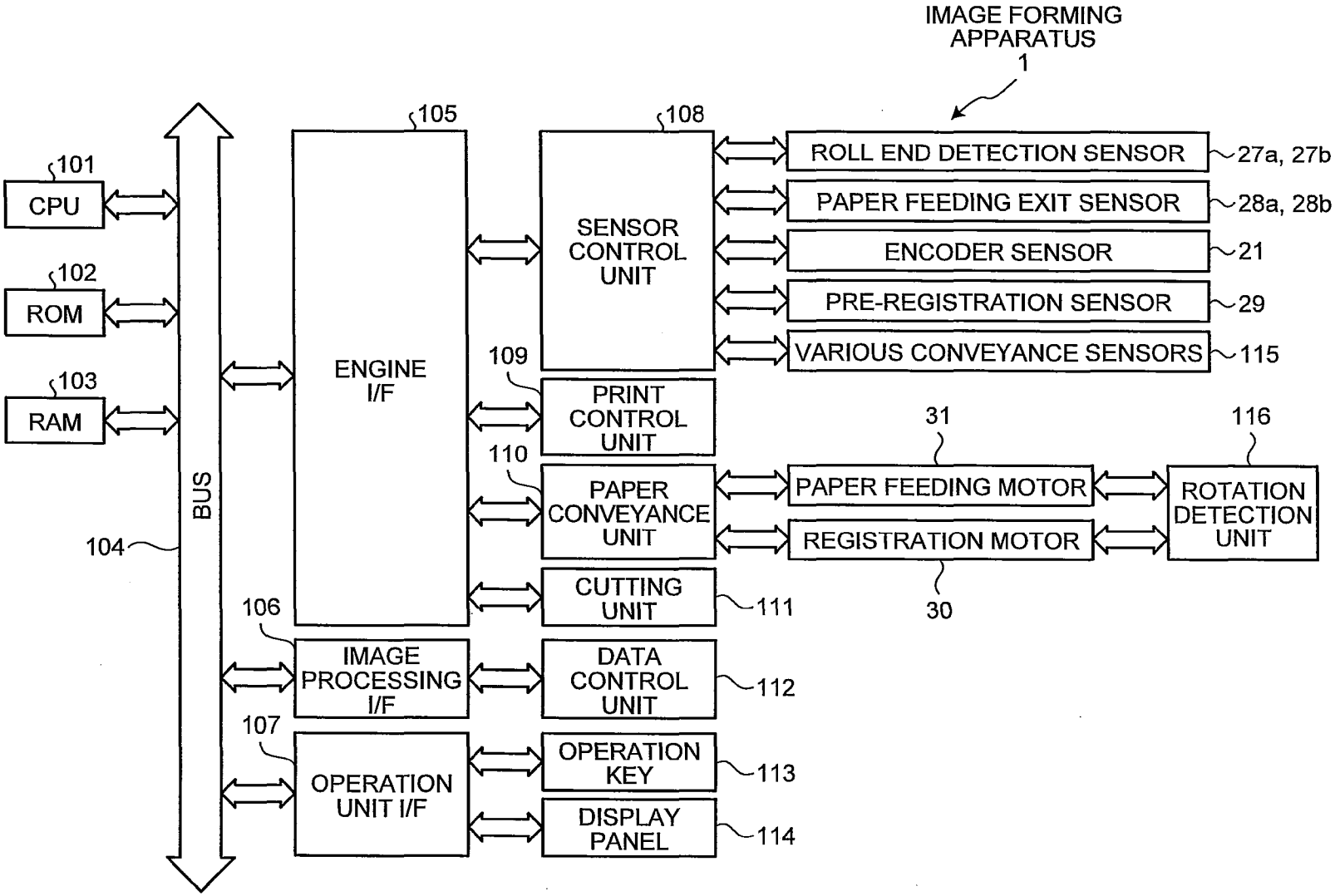
FIG. 4 is a block diagram of a principal part of the image forming apparatus.

As illustrated in FIG. 4, the image forming apparatus 1 includes a CPU (Central Processing Unit) 101, a ROM (Read Only Memory) 102, a RAM (Random Access Memory) 103, a bus 104, an engine I/F 105, an image processing I/F 106, an operation unit I/F 107, a sensor control unit 108, a print control unit 109, a paper conveyance unit 110, a cutting unit 111, a data control unit 112, an operation key 113, a display panel 114, the roll end detection sensors 27*a* and 27*b*, the paper feeding exit sensors 28*a* and 28*b*, the encoder sensor 21, the pre-registration sensor 29, various conveyance sensors 115, the paper feeding motor 31, the registration motor 30, a rotation detection unit 116, and the like.

The ROM 102 stores a basic program as the image forming apparatus 1, a program such as the rolled recording medium conveyance program according to the present invention, and required data.

The CPU 101 uses the RAM 103 as a work memory to control each unit of the image forming apparatus 1 and execute basic processing as the image forming apparatus 1 on the basis of the program stored in the ROM 102, and at the same time executes a rolled recording medium conveyance process which controls the conveyance of the rolled recording medium (the rolled paper) according to the present invention as described below. For example, when the CPU 101 detects an end (the end edge) of the rolled paper P on the basis of the roll paper recording medium conveyance program to be described below, the CPU 101 performs: a process of forming an image on the end edge portion of the rolled paper P and then discharging the paper onto a paper discharge tray; a process of discharging the paper onto the paper discharge tray without forming an image on the end portion; and a process of rolling up the end portion around the core pipe Ps.

That is, the image forming apparatus 1 is constructed as an image forming apparatus that executes the rolled recording medium conveyance method described below by which the end edge portion of the rolled paper P is discharged from the conveyance paths 26*a* and 26*b* by reading the rolled recording medium conveyance program recorded in a recording medium that can be read by a computer and introducing the program into the ROM 102 or the like, the rolled recording medium conveyance program executing the rolled recording medium conveyance method by which the end edge portion of the rolled paper P according to the present invention is discharged from the conveyance paths 26*a* and 26*b*, and the recording medium including a ROM, an EEPROM (Electrically Erasable and Programmable Read Only Memory), an EPROM, a flash memory, a flexible disk, a CD-ROM (Compact Disc Read Only Memory), a CD-RW (Compact Disc Rewritable), a DVD (Digital Versatile Disk), an SD (Secure Digital) card, or an MO (Magneto-Optical Disc). The rolled recording medium conveyance program is a program that can be executed by a computer and written in a legacy programming language or an object-oriented programming language such as assembler, C, C++, C#, or Java(Registered Trademark) and can be distributed while being stored in the recording medium.

The sensor control unit 108, the print control unit 109, the paper conveyance unit 110, and the cutting unit 111 are connected to the engine I/F 105 of the image forming apparatus 1. The engine I/F 105 is an interface that transfers a signal of the CPU 101 and data to/from the sensor control unit 108, the print control unit 109, the paper conveyance unit 110, and the cutting unit 111.

The detection sensors 27*a* and 27*b*, the paper feeding exit sensors 28*a* and 28*b*, the encoder sensor 21, the pre-registration sensor 29, and the other various conveyance sensors 115 are connected to the sensor control unit 108. The other various conveyance sensors 115 can be a sensor which detects opening/closing of the cover 16, for example. The sensor control unit 108 controls the operation of various sensors as well as receives a detection signal therefrom and transfers it to the CPU 101 through the engine I/F 105.

Although not shown, a recording head, the main scanning motor 10 and the like are connected to the print control unit 109. The print control unit 109 performs control to form an image onto the rolled paper P by making an ink droplet eject from the recording head toward the rolled paper P while moving the carriage 6 in the main-scanning direction on the basis of printing data and a control signal transferred from the CPU 101 through the engine I/F 105.

The paper feeding motor 31, the registration motor 30, and the rotation detection unit 116 are connected to the paper conveyance unit 110 where the rotation detection unit 116 detects rotation of the paper feeding motor 31 and the registration motor 30. The paper conveyance unit 110 controls the conveyance of the rolled paper P by controlling the rotation of the paper feeding motor 31 and the registration motor 30 under control of the CPU 101.

The cutting unit 111 includes the cutter 32 and a drive unit which drives the cutter 32, and cuts the rolled paper P in the main-scanning direction by making the drive unit operate the cutter 32 under control of the CPU 101 through the engine I/F 105.

The data control unit 112 is connected to the image processing I/F 106 which transfers a control signal and data between the CPU 101 and the data control unit 112. The data control unit 112 writes/reads image data to/from a hard disk (not shown) under control of the CPU 101 and performs necessary image processing.

The operation key 113 and the display panel 114 are connected to the operation unit I/F 107 which serves as an interface between the operation key 113/the display panel 114 and the CPU 101. The operation key 113 is provided with various keys required to operate the image forming apparatus 1, and the operation unit I/F 107 acquires content of operation performed by the operation key 113 and transfers the content to the CPU 101. The display panel 114 includes a liquid crystal panel and an LED (Light Emitting Diode), and the display panel 114, for example, displays on the liquid crystal panel display data transferred from the CPU 101 through the operation unit I/F 107, and turns on/off the LED.

Once roll end detection sensors 27*a* and 27*b* have detected that the end edge portion of the rolled paper P does not come off the core portion such as the core pipe Ps of the rolled paper P and that the amount of the rolled paper P equals a predetermined amount or less, the CPU 101 functions as a conveyance control unit which performs a conveyance control process in which the rolled paper P is conveyed in the forward conveyance direction for a predetermined period of time by driving the paper feeding motor 31 and the registration motor 30 being the conveyance unit through the paper conveyance unit 110. On the basis of a detection result by either the roll end detection sensors 27*a* and 27*b* (the first recording medium detection units) or the second recording medium detection unit such as the pre-registration sensor 29 or the paper feeding exit sensors 28*a* and 28*b* while or after the rolled paper P is conveyed for the predetermined period of time, the CPU 101 functions as a control unit which performs a control process by which the conveyance unit conveys the rolled paper P in the forward conveyance direction or the reverse conveyance direction opposite from the forward conveyance direction.

An operation of the present embodiment will now be described. The image forming apparatus 1 according to the present embodiment discharges the end edge portion of the rolled paper P from the conveyance paths 26*a* and 26*b*.

Figure 5:
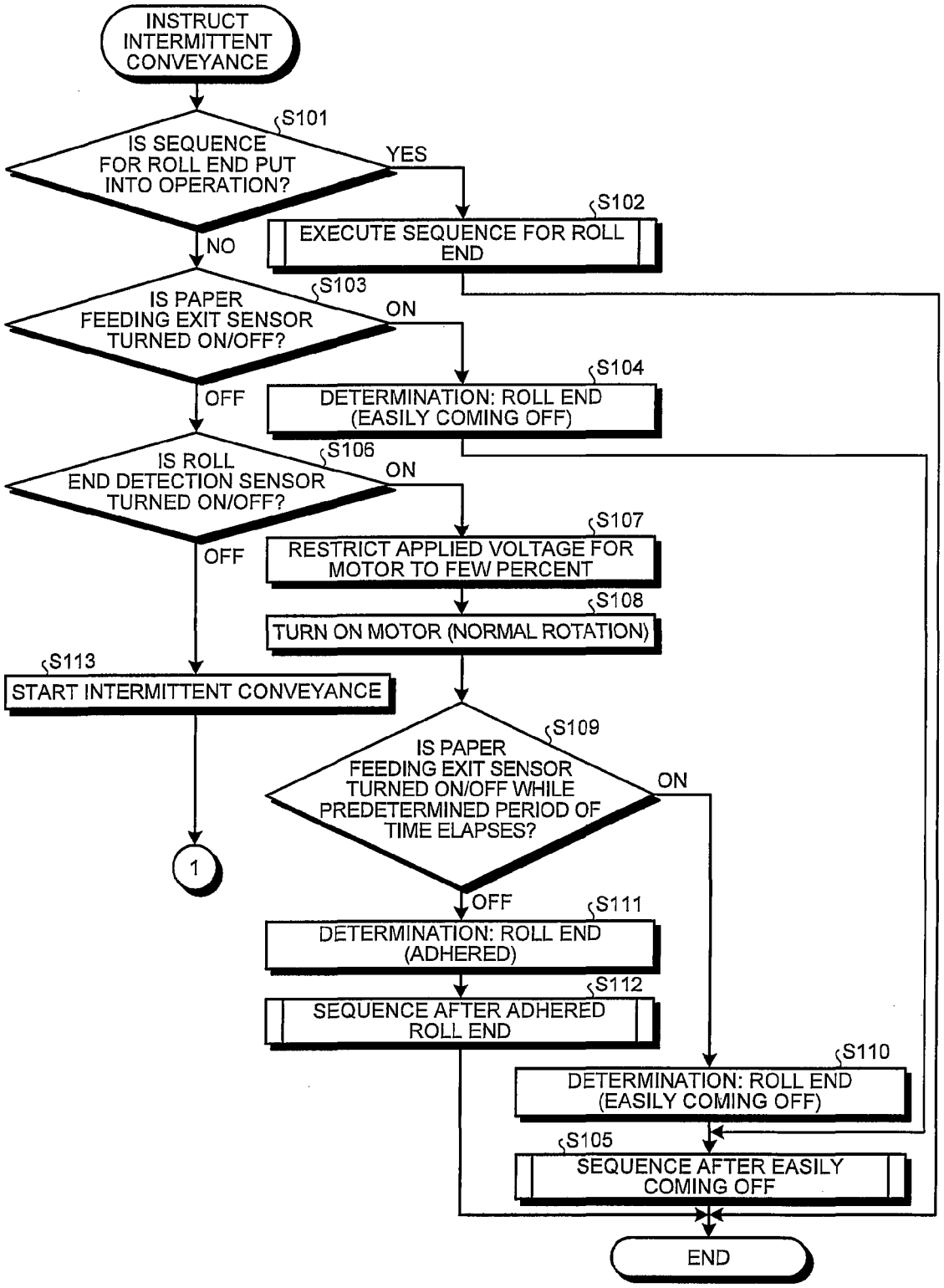
FIG. 5 is a flowchart illustrating a rolled paper conveyance control process.
Figure 6:
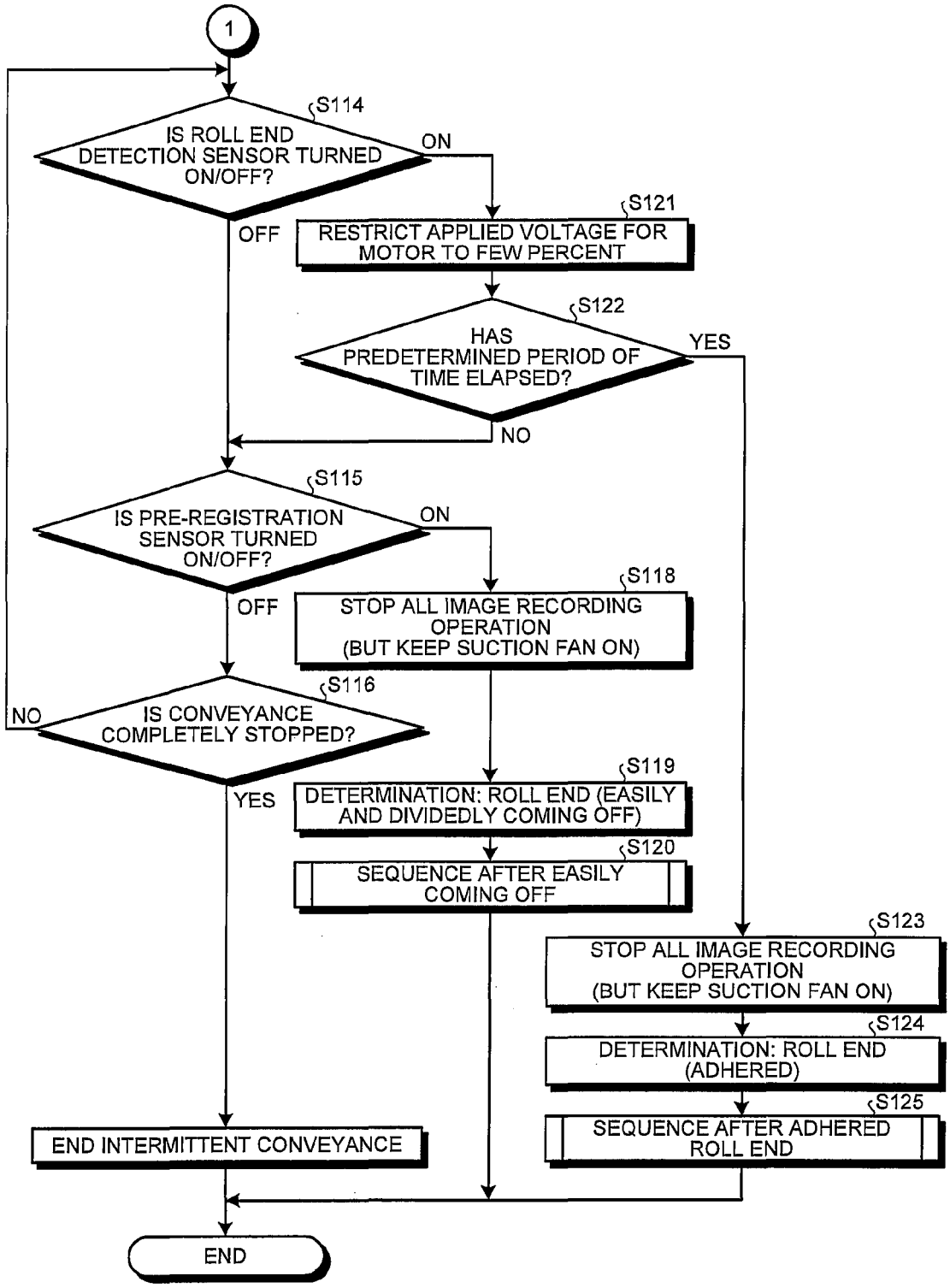
FIG. 6 is a flowchart illustrating the rest of the rolled paper conveyance control process.

FIGS. 5 and 6 illustrate an operational example where the image forming apparatus 1 according to the present embodiment determines an end state of the rolled paper P.

When there occurs an instruction to start intermittent conveyance of the rolled paper P to perform image recording, the CPU 101 first checks whether or not a sequence for that the roll end easily comes off (hereinafter, referred to as the sequence for roll end) is put into operation (step S101). Specifically, when the CPU 101 detects the roll end (the end edge) of the rolled paper P, the CPU 101 intermittently conveys the end edge portion of the rolled paper P in the forward conveyance direction. The CPU 101 then performs sequence for the roll end, in which an image is formed on the end portion (the end edge portion) of the rolled paper P, and then the roll end is discharged onto the paper discharge tray. Note that the sequence for the roll end will later be described in detail.

In step S101, when the sequence for roll end is activated (YES in step S101), the CPU 101 executes the activated sequence for end roll (step S102). When the sequence for roll end is completed, the CPU 101 ends a rolled paper conveyance control process.

In step S101, the sequence for roll end is not put into operation (NO in step S101), the CPU 101 checks an ON/OFF state of the paper feeding exit sensors 28*a* and 28*b* (step S103).

Figure 7A:
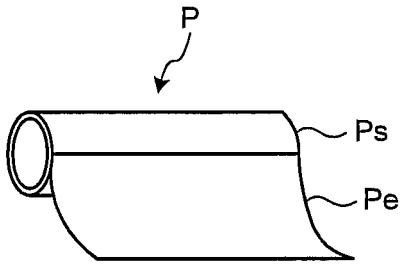
FIGS. 7(*a*) to 7(*c*) are diagrams each illustrating a state of a roll end of rolled paper with respect to a core pipe.
Figure 7B:
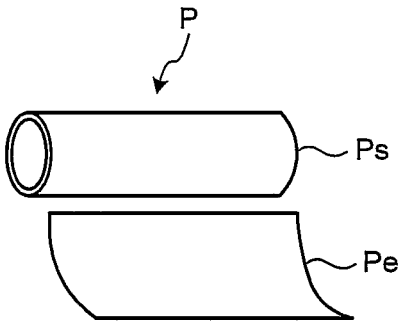
Figure 7C:
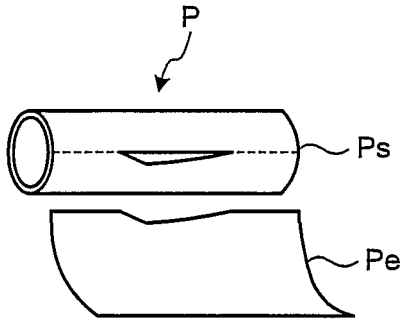

When the paper feeding exit sensors 28*a* and 28*b* are ON in step S103 (the rolled paper P is not detected by the paper feeding exit sensors 28*a* and 28*b*), the CPU 101 determines that the roll end (the end edge of the rolled paper P) has "easily" came off from the core pipe Ps (step S104). That is, as illustrated in FIGS. 7(*a*) to 7(*c*), the rolled paper P includes: the one with a roll end Pe securely adhered to the core pipe Ps (the rolled paper P in FIG. 7(*a*)); the one with the roll end Pe simply rolled around the core pipe Ps and "easily" coming off altogether (the rolled paper P in FIG. 7(*b*)); and the one with the roll end Pe incompletely adhered to the core pipe Ps and thus "easily and dividedly coming off" in an incomplete manner when pulled to a certain extent (the rolled paper P in FIG. 7(*c*)). As for the rolled paper P with the core portion thereof not rolled around the core pipe Ps but rolled up, the rolled paper P includes: the one with the rolled up core portion mutually "adhered" at the end edge; the one with the core portion weakly adhered and thus "easily and dividedly coming off"; and the one with the core portion not adhered and "easily" coming off.

In step S104, the CPU 101 determines that the roll end corresponds to the case where the roll end either "easily" comes off or "easily and dividedly comes off" as illustrated in FIGS. 7(*b*) and 7(*c*), respectively, and performs the sequence processing after that the roll end easily comes off (step S105). In the sequence processing after that the roll end easily comes off (hereinafter, refers as the sequence after easily coming off), the CPU 101 performs control to rotate the registration motor 30 to convey the roll end Pe of the rolled paper P on the conveyance paths 26*a* and 26*b* onto the platen 14, when an amount of image information is less than an amount of the roll end Pe of the rolled paper P on which the image can be recorded. The CPU 101 performs control to form the image by ejecting the ink from the recording head mounted in the carriage 6 onto the roll end Pe portion of the rolled paper P being conveyed onto the platen 14, and then discharges the roll end to the outside. In other words, when the amount of image information is less than the amount of the roll end Pe of the rolled paper P on which the image can be recorded, the CPU 101 performs, in the sequence after easily coming off, the process of forming the image on the roll end Pe portion of the rolled paper P left on the conveyance paths 26*a* and 26*b* and discharging the roll end to the outside.

The CPU 101 ends the rolled paper conveyance control process after performing the sequence after easily coming off.

Determining in step S103 that the paper feeding exit sensors 28*a* and 28*b* are in the OFF state (the rolled paper P is present at the position of the paper feeding exit sensors 28*a* and 28*b*), the CPU 101 checks an ON/OFF state of the roll end detection sensors 27*a* and 27*b* (step S106).

In step S106, when the roll end detection sensors 27*a* and 27*b* are in the ON state, the CPU 101 restricts the applied voltage (drive voltage) for the registration motor 30 and the paper feeding motor 31 to a few % of the normal applied voltage (step S107). That is, the CPU 101 determines, when the roll end detection sensors 27*a* and 27*b* are in the ON state, that the rolled paper P has been consumed up to around the roll end Pe and that the end edge of the rolled paper P is adhered to the core pipe Ps or easily and dividedly coming off. However, it cannot be determined at this stage whether the end edge is easily and dividedly coming off or adhered. There is a great load on the registration motor 30 and the paper feeding motor 31 in conveying the rolled paper P when the end edge is adhered to the core pipe Ps. Thus, the CPU 101 reduces the load on the registration motor 30 and the paper feeding motor 31 in conveying the rolled paper P with the end edge adhered to the core pipe Ps by restricting the applied voltage for the registration motor 30 and the paper feeding motor 31 to the few % of the normal, thereby suppressing heat generation or deterioration.

The CPU 101 thereafter turns ON the motors 30 and 31 in the normal rotation direction (the forward conveyance direction) (step S108) and monitors the ON/OFF state of the paper feeding exit sensors 28*a* and 28*b* while a predetermined period of time elapses (step S109).

In other words, the CPU 101 drives the motors 30 and 31 in the normal rotation direction in order to add tension force to the rolled paper P, peel the roll end Pe off the core pipe Ps, and discharge the roll end from the conveyance paths 26*a* and 26*b* when the roll end detection sensors 27*a* and 27*b* are turned ON. In the image forming apparatus 1, the predetermined period of time is calculated by an experiment or the like by finding the time required for the roll end Pe to come off from the core pipe Ps with the power of the motors 30 and 31 driven by the applied voltage that is a few % of the normal. The predetermined period of time is stored in the ROM (Read Only Memory) 102 or the like.

In step S109, when the paper feeding exit sensors 28*a* and 28*b* are turned ON while the predetermined period of time elapses, the CPU 101 determines that the roll end Pe has "easily and dividedly came off" as illustrated in FIG. 7(*c*) (step S110). That is, the state from steps S106 to S109 corresponds to the case where the roll end Pe of the rolled paper P is adhered to the core pipe Ps and pulled so that the roll end detection sensors 27*a* and 27*b* are turned ON, as illustrated by the dotted line in FIG. 3. The motors 30 and 31 are then driven so that the roll end Pe falls off of the core pipe Ps and that the paper feeding exit sensors 28*a* and 28*b* are in the state not detecting the rolled paper P (the ON state).

In step S110, when the roll end has "easily and dividedly came off", the CPU 101 performs the sequence after easily coming off in order to discharge the roll end Pe that came off from the core pipe Ps from the conveyance paths 26*a* and 26*b* (step S105).

The CPU 101 ends the rolled paper conveyance control process after performing the sequence after easily coming off.

In step S109, when the paper feeding exit sensors 28*a* and 28*b* remain OFF after the predetermined period of time has elapsed, the CPU 101 determines that the roll end Pe stays "adhered" as illustrated in FIG. 7(*a*) (step S111).

In step S111, when the roll end Pe is "adhered", the CPU 101 performs sequence processing after detecting that the roll end is adhered (step S112). In the sequence processing after detecting that the roll end is adhered (hereinafter, refers as the sequence after adhered roll end), the CPU 101 reverses the motors 30 and 31 in the reverse rotation direction for a predetermined period of time in order to roll the roll end Pe pulled out from the core pipe Ps back around the core pipe Ps and discharge it from the conveyance paths 26*a* and 26*b*. The CPU 101 thereafter stops driving the motors 30 and 31.

The CPU 101 ends the rolled paper conveyance control process after performing the sequence processing after adhered roll end.

When the roll end detection sensors 27*a* and 27*b* are turned OFF in step S106, the CPU 101 intermittently drives the registration motor 30 and the paper feeding motor 31 to start intermittent conveyance of the rolled paper P (step S113). In this case, the roll end detection sensors 27*a* and 27*b* are not turned ON by the rolled paper P being pulled by the core pipe Ps. As a result, the CPU 101 determines that the rolled paper P has not been consumed up to around the roll end Pe yet and starts the intermittent conveyance of the rolled paper P in order to perform image recording.

Once the intermittent conveyance of the rolled paper P has started, as shown in FIG. 6, the CPU 101 checks the ON/OFF state of the roll end detection sensors 27*a* and 27*b* (step S114) and, when they are OFF, checks an ON/OFF state of the pre-registration sensor 29 (step S115).

In step S115, the CPU 101 determines that the rolled paper P is correctly conveyed onto the platen 14 when the pre-registration sensor 29 is turned OFF, namely, the rolled paper P is present at the position of the pre-registration sensor 29. The CPU 101 then determines whether or not to complete and stop the intermittent conveyance operation required in image formation (step S116).

When the intermittent conveyance operation is not completed in step S116 (NO in step S116), the CPU 101 returns to step S114 and performs the similar process starting from checking the ON/OFF state of the roll end detection sensors 27*a* and 27*b* (steps S114 to S116).

When the roll end detection sensors 27*a* and 27*b* are turned OFF in step S114 but the pre-registration sensor 29 is turned ON in step S115, the CPU 101 stops all image recording operations because the rolled paper P is not conveyed onto the platen 14 (step S118).

Next, the CPU 101 determines that the roll end Pe of the rolled paper P has "easily" came off (step S119), executes the sequence processing after easily coming off, and ends the rolled paper conveyance control process (step S120).

In step S114, when the roll end detection sensors 27*a* and 27*b* are turned ON, the CPU 101 determines that the rolled paper P has been consumed up to around the roll end Pe and that the end edge of the rolled paper P is adhered to the core pipe Ps or is in the state where the roll end is easily and divided comes off, and restricts the applied voltage (the drive voltage) for the registration motor 30 and the paper feeding motor 31 intermittently driven to a few % of the voltage applied in normal drive (step S121). That is, the load on the motors 30 and 31 conveying the rolled paper P with the end edge adhered to the core pipe Ps is reduced by restricting the applied voltage for the registration motor 30 and the paper feeding motor 31 to the few % of the normal applied voltage, thereby suppressing the heat generation or the deterioration.

The CPU 101 then checks whether a predetermined period of time has elapsed (step S122) and, when the predetermined period of time has not elapsed, shifts to step S115 described above and checks the ON/OFF state of the pre-registration sensor 29 (step S115). Similar to the predetermined period of time described in step S109, this predetermined period of time corresponds to the time required for the roll end Pe to fall off of the core pipe Ps with the power of the motors 30 and 31 driven by the applied voltage that is a few % of the normal applied voltage.

In step S115, when the pre-registration sensor 29 is turned ON, the CPU 101 stops the image recording operation as with the case above (step S118) and determines that the roll end has "easily and dividedly came off" as illustrated in FIG. 7(*c*) (step S119).

The CPU 101 thereafter performs the sequence processing after gently-falling roll end and ends the rolled paper conveyance control process (step S120).

In step S115, when the pre-registration sensor 29 is turned OFF, the CPU 101 determines whether to complete and stop the intermittent conveyance as with the case above (step S116) and returns to step S114 when the intermittent conveyance is not completely stopped.

When the predetermined period of time has elapsed in step S122, the CPU 101 stops all the image recording operations (step S123) and determines that the roll end Pe is "adhered" to the core pipe Ps (step S124).

The CPU 101 performs the sequence after adhered roll end similar to that performed in step S112 and ends the rolled paper conveyance control process after completing the sequence after adhered roll end (step S125).

Note that in the aforementioned description, the end edge of the rolled paper P is rolled around the core pipe Ps while being or not being adhered thereto. The rolled paper P however may be the one with the core portion not including the core pipe Ps but rolled up as described above. For example, the rolled paper P may be the one into which a spool rotatably inserted to each of the supporting portions 22*a* and 22*b* of the spool bearing stands 21*a* and 21*b* is inserted in the central position of the rolled paper. The rolled paper P not including the core pipe Ps includes the one with the core portion that is "adhered", the core portion that "easily and dividedly comes off", and the core portion that "easily comes off" as described above.

While the pre-registration sensor 29 and the paper feeding exit sensors 28*a* and 28*b* are used as the second recording medium detection unit in the aforementioned description, the second recording medium detection unit is not limited to these sensors. The second recording medium detection unit may be a recording medium detection unit which is located on the downstream side of at least the roll end detection sensors 27*a* and 27*b* being the first recording medium detection unit in the forward conveyance direction of the rolled paper P and can detect the presence of the rolled paper P.

As described above, the image forming apparatus 1 according to the present embodiment includes: the conveyance unit including the pair of conveyance rollers 23*a* and 23*b*, the paper feeding motor 31, the registration roller 24, the registration pressure roller 25, and the registration motor 30 which convey the rolled paper P pulled out from the rolled paper (the recording medium) P with the forward conveyance direction corresponding to the direction in which the rolled paper is pulled out; the roll end detection sensors (the first recording medium detection units) 27*a* and 27*b* which output a predetermined signal when the end portion of the rolled paper P on the upstream side of the forward conveyance direction is not detached from the core portion of the rolled paper P and the amount of the rolled paper P equals the predetermined amount or less; the second recording medium detection unit such as the paper feeding exit sensors 28*a* and 28*b* or the pre-registration sensor 29 which detects the presence of the rolled paper P on the downstream side of the roll end detection sensors 27*a* and 27*b* in the forward conveyance direction; the CPU (the conveyance control unit) 101 which conveys the rolled paper P being pulled out by the conveyance unit for the predetermined period of time in the forward conveyance direction when the roll end detection sensors 27*a* and 27*b* have output the predetermined signal; and the CPU (the control unit) 101 which causes the conveyance unit to convey the rolled paper P in the forward conveyance direction or the reverse conveyance direction opposite from the forward conveyance direction on the basis of the detection result by at least either the roll end detection sensors 27*a* and 27*b* or the second recording medium detection unit while or after the rolled paper P is conveyed for the predetermined period of time.

Therefore, the image forming apparatus 1 determines the conveyance direction of the rolled paper P in accordance with the rolled state of the roll end Pe at the core portion and discharges or rolls back the roll end Pe portion from the conveyance paths 26*a* and 26*b* when the rolled paper P has come close to the roll end Pe. As a result, the roll end (the end edge portion) Pe portion of the rolled paper P can be discharged from the conveyance paths 26*a* and 26*b*, thereby improving usability while saving a manual operation of removing the roll end Pe portion.

Moreover, the image forming apparatus 1 according to the present embodiment executes the rolled recording medium conveyance method including: a conveyance process step of conveying the rolled paper P pulled out from the rolled paper P with the forward conveyance direction corresponding to a direction in which the rolled paper is pulled out; a first recording medium detection process step of outputting a predetermined signal when the end portion of the rolled paper P on the upstream side of the forward conveyance direction is not detached from the core portion of the rolled paper P and an amount of the rolled paper P equals a predetermined amount or less; a second recording medium detection process step of detecting presence of the rolled paper P on the downstream side of the first recording medium detection process step in the forward conveyance direction; a conveyance control process step of conveying the rolled paper P pulled out in the conveyance process step for a predetermined period of time in the forward conveyance direction when the predetermined signal is output in the first recording medium detection process step; and a control process step of conveying the rolled paper P in the forward conveyance direction or the reverse conveyance direction opposite from the forward conveyance direction in the conveyance process step on the basis of the detection result by at least either the first recording medium detection process step or the second recording medium detection process step while or after the rolled paper P is conveyed for the predetermined period of time by the conveyance control process step.

Therefore, the image forming apparatus 1 determines the conveyance direction of the rolled paper P in accordance with the rolled state of the roll end Pe at the core portion and discharges or rolls back the roll end Pe portion from the conveyance paths 26*a* and 26*b* when the rolled paper P has come close to the roll end Pe. As a result, the roll end (the end edge portion) Pe portion of the rolled paper P can be discharged from the conveyance paths 26*a* and 26*b*, thereby allowing the usability to be improved while saving the manual operation of removing the roll end Pe portion.

Furthermore, installed in the image forming apparatus 1 according to the present embodiment is the rolled recording medium conveyance program which causes the CPU 101 being a control processor to execute a process including: a conveyance process of conveying the rolled paper P pulled out from the rolled paper P with the forward conveyance direction corresponding to a direction in which the rolled paper is pulled out; a first recording medium detection process of outputting a predetermined signal when the end portion of the rolled paper P on the upstream side of the forward conveyance direction is not detached from the core portion of the rolled paper P and an amount of the rolled paper P equals a predetermined amount or less; a second recording medium detection process of detecting presence of the rolled paper P on the downstream side of the first recording medium detection process in the forward conveyance direction; a conveyance control process of conveying the rolled paper P pulled out in the conveyance process for a predetermined period of time in the forward conveyance direction when the predetermined signal is output in the first recording medium detection process; and a control process of conveying the rolled paper P in the forward conveyance direction or the reverse conveyance direction opposite from the forward conveyance direction in the conveyance process on the basis of the detection result by at least either the first recording medium detection process or the second recording medium detection process while or after the rolled paper P is conveyed for the predetermined period of time by the conveyance control process.

Therefore, the image forming apparatus 1 determines the conveyance direction of the rolled paper P in accordance with the rolled state of the roll end Pe at the core portion and discharges or rolls back the roll end Pe portion from the conveyance paths 26*a* and 26*b* when the rolled paper P has come close to the roll end Pe. As a result, the roll end (the end edge portion) Pe portion of the rolled paper P can be discharged from the conveyance paths 26*a* and 26*b*, thereby allowing the usability to be improved while saving the manual operation of removing the roll end Pe portion.

In the image forming apparatus 1 according to the present embodiment, the conveyance unit including the pair of conveyance rollers 23*a* and 23*b*, the paper feeding motor 31, the registration roller 24, the registration pressure roller 25 and the registration motor 30 conveys the rolled paper P in the reverse conveyance direction when the roll end detection sensors 27*a* and 27*b* detect the state where the rolled paper P is not detached from the core portion such as the core pipe Ps after the CPU 101 as the control unit has served as the conveyance control unit and conveyed the rolled paper P for the predetermined period of time.

The image forming apparatus 1 can thus roll back the rolled paper P pulled out from the core portion when the roll end Pe of the rolled paper P is adhered to the core portion such as the core pipe Ps. As a result, the roll end (the end edge portion) Pe of the rolled paper P can be discharged from the conveyance paths 26*a* and 26*b*, thereby allowing the usability to be improved while saving the manual operation of discharging the roll end Pe from the conveyance paths 26*a* and 26*b*.

Moreover, in the image forming apparatus 1 according to the present embodiment, the conveyance unit including the pair of conveyance rollers 23*a* and 23*b*, the paper feeding motor 31, the registration roller 24, the registration pressure roller 25 and the registration motor 30 conveys the rolled paper P in the forward conveyance direction when the second recording medium detection unit such as the paper feeding exit sensors 28*a* and 28*b* and the pre-registration sensor 29 detects no rolled paper P before the predetermined period of time has elapsed since the CPU 101 as the control unit started conveying the rolled paper P as the conveyance control unit.

The image forming apparatus 1 can thus discharge the roll end (the end edge portion) Pe of the rolled paper P being pulled out from the core portion from the conveyance paths 26*a* and 26*b* to the outside when the roll end Pe of the rolled paper P falls off of the core portion such as the core pipe Ps. As a result, the usability can be improved by saving the manual operation of discharging the roll end Pe from the conveyance paths 26*a* and 26*b*.

Furthermore, in the image forming apparatus 1 according to the present embodiment, when the second recording medium detection unit such as the paper feeding exit sensors 28*a* and 28*b* and the pre-registration sensor 29 detects no rolled paper P regardless of the detection result by the roll end detection sensors 27*a* and 27*b*, the CPU 101 as the control unit causes the conveyance unit, that includes the pair of conveyance rollers 23*a* and 23*b*, the paper feeding motor 31, the registration roller 24, the registration pressure roller 25 and the registration motor 30, to convey the rolled paper P in the forward conveyance direction.

Thus, the image forming apparatus 1 can discharge the roll end (the end edge portion) Pe of the rolled paper P being pulled out from the core portion from the conveyance paths 26*a* and 26*b* to the outside, when the roll end Pe of the rolled paper P falls off of the core portion such as the core pipe Ps. As a result, the usability can be improved by saving the manual operation of discharging the roll end Pe from the conveyance paths 26*a* and 26*b*.

Furthermore, in the image forming apparatus 1 according to the present embodiment, the CPU 101 as the conveyance control unit causes the conveyance unit to convey the rolled paper P for the predetermined period of time with the driving power weaker by a predetermined amount than the normal conveyance driving power, the conveyance unit including the pair of conveyance rollers 23*a* and 23*b*, the paper feeding motor 31, the registration roller 24, the registration pressure roller 25 and the registration motor 30.

This can therefore prevent the conveyance unit, particularly the paper feeding motor 31 and the registration motor 30, from being heated, thereby allowing the durability to be improved by preventing deterioration.

While the aforementioned description is applied to the image forming apparatus employing the ink ejection method, the description herein can also be applied to an image forming apparatus in general which employs the rolled recording medium by withdrawing it.

According to the present invention, the end edge portion of the rolled recording medium can be discharged from the conveyance path.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a conveyance unit to convey a recording medium from a roll in a forward direction for image formation on the recording medium;

a first sensor unit to detect that the recording medium pulled out from the roll is not detached from a core portion and an amount of the recording medium remaining in the roll is below a threshold;

a second sensor unit to detect whether the recording medium is present at a downstream location from the first sensor unit in the forward direction; and a control unit to, in response to an indication that the amount of the recording medium remaining on the roll is below the threshold and is not detached from the core portion:

direct the conveyance unit to convey the recording medium in the forward direction for a predetermined period of time; and direct the conveyance unit to convey the recording medium in a reverse direction to rewind the recording medium on the roll in response to a determination that the recording medium is present at the downstream location after the period of time elapses;

wherein when the recording medium pulled out from the roll is detached from the core portion, or when the amount of the recording medium remaining in the roll is not below the threshold, the first sensor unit is not in contact with the recording medium pulled out from the roll, and wherein when the recording medium pulled out from the roll is not detached from the core portion and the amount of the recording medium remaining in the roll is below the threshold, the first sensor unit is in contact with the rolled recording medium pulled out from the roll to detect the contact.

2. The image forming apparatus of claim 1 wherein:

the control unit is further configured, in response to the indication that the amount of the recording medium remaining on the roll is below the threshold, to stop the image formation on the recording medium.

3. The image forming apparatus of claim 1 wherein:

the first sensor unit comprises an arm having an end that is disposed a distance from a surface of the recording medium when the amount of the recording medium remaining on the roll is above the threshold, and the end of the arm contacts the surface of the recording medium when the amount of the recording medium remaining on the roll is below the threshold.

4. The image forming apparatus of claim 1 wherein:

the second sensor unit comprises an exit sensor to detect whether the recording medium is present at the downstream location from the first sensor unit in the conveyance direction, and a registration sensor to detect whether the recording medium is present at another downstream location that is downstream from the exit sensor in the conveyance direction.

5. The image forming apparatus of claim 1 wherein:

the period of time corresponds to a time for conveying the amount of the recording medium remaining on the roll that is below the threshold past the second sensor unit.

6. The image forming apparatus of claim 1 wherein:

the roll of the recording medium is mounted to the image forming apparatus.

7. A method comprising:

conveying a recording medium from a roll in a forward direction for image formation on the recording medium; and detecting that the recording medium pulled out from the roll is not detached from a core portion and an amount of the recording medium remaining in the roll is below a threshold, and in response thereto:

conveying the recording medium for a period of time in the forward direction;

determining whether the recording medium is present at a downstream location from the roll in the forward direction; and conveying the recording medium in a reverse direction to rewind the recording medium on the roll in response to determining that the recording medium is present at the downstream location after the period of time elapses wherein when the recording medium pulled out from the roll is detached from the core portion, or when the amount of the recording medium remaining in the roll is not below the threshold, the first sensor unit is not in contact with the recording medium pulled out from the roll, and wherein when the recording medium pulled out from the roll is not detached from the core portion and the amount of the recording medium remaining in the roll is below the threshold, the first sensor unit is in contact with the rolled recording medium pulled out from the roll to detect the contact.

8. A non-transitory computer readable medium embodying programmed instructions, which, when executed by a processor, are operable for performing a method comprising:

conveying a recording medium from a roll in a forward direction for image formation on the recording medium; and detecting that the recording medium pulled out from the roll is not detached from a core portion and an amount of the recording medium remaining in the roll is below a threshold, and in response thereto:

conveying the recording medium for a period of time in the forward direction;

determining whether the recording medium is present at a downstream location from the roll in the forward direction; and conveying the recording medium in a reverse direction to rewind the recording medium on the roll in response to determining that the recording medium is present at the downstream location after the period of time elapses wherein when the recording medium pulled out from the roll is detached from the core portion, or when the amount of the recording medium remaining in the roll is not below the threshold, the first sensor unit is not in contact with the recording medium pulled out from the roll, and wherein when the recording medium pulled out from the roll is not detached from the core portion and the amount of the recording medium remaining in the roll is below the threshold, the first sensor unit is in contact with the rolled recording medium pulled out from the roll to detect the contact.

* * * * *